US007101216B2

(12) United States Patent
Fasce et al.

(10) Patent No.: US 7,101,216 B2
(45) Date of Patent: Sep. 5, 2006

(54) INSULATION DISPLACEMENT SYSTEM FOR TWO ELECTRICAL CONDUCTORS

(75) Inventors: Xavier Fasce, Verchaix (FR); Guy Metral, Cluses (FR); Jerome A. Pratt, Georgetown, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 43 days.

(21) Appl. No.: 10/941,506

(22) Filed: Sep. 15, 2004

(65) Prior Publication Data

US 2006/0057883 A1 Mar. 16, 2006

(51) Int. Cl.
*H01R 11/20* (2006.01)

(52) U.S. Cl. ..... 439/402; 439/404; 439/408; 439/409

(58) Field of Classification Search ..... 439/395, 439/397, 398, 402, 404, 405, 408, 409
See application file for complete search history.

(56) References Cited

U.S. PATENT DOCUMENTS

| | | | | |
|---|---|---|---|---|
| 3,617,983 | A | 11/1971 | Patton | |
| 3,702,456 | A | 11/1972 | Patton | |
| 3,845,455 | A * | 10/1974 | Shoemaker | 439/399 |
| 3,854,114 | A * | 12/1974 | Kloth et al. | 439/398 |
| 4,017,140 | A | 4/1977 | Reavis, Jr. et al. | |
| 4,046,446 | A * | 9/1977 | Reavis, Jr. | 439/401 |
| 4,192,570 | A * | 3/1980 | Van Horn | 439/402 |
| 4,508,411 | A | 4/1985 | Hughes et al. | |
| 4,533,196 | A | 8/1985 | Forberg et al. | |
| 4,541,679 | A | 9/1985 | Fiedler et al. | |
| 4,795,363 | A | 1/1989 | Scherer et al. | |
| 4,815,988 | A | 3/1989 | Scherer | |
| 4,932,894 | A | 6/1990 | Scherer | |
| 4,995,829 | A | 2/1991 | Geib et al. | |
| 5,178,558 | A | 1/1993 | Knox et al. | |
| 5,199,899 | A | 4/1993 | Ittah | |
| 5,281,163 | A | 1/1994 | Knox et al. | |
| 5,435,747 | A | 7/1995 | Franckx et al. | |
| 5,449,299 | A | 9/1995 | Shimirak et al. | |
| 5,504,654 | A | 4/1996 | Knox et al. | |
| 5,549,489 | A | 8/1996 | Baggett et al. | |

(Continued)

FOREIGN PATENT DOCUMENTS

DE 33 13 654 A1 10/1984

(Continued)

OTHER PUBLICATIONS

U.S. Appl. No. 10/941,441; Xavier Fasce et al, filed Sep. 15, 2004, entitled "Connector Assembly for Housing Insulation Displacement Elements".

(Continued)

*Primary Examiner*—Tho D. Ta
(74) *Attorney, Agent, or Firm*—John A. Burtis

(57) ABSTRACT

An electrically coupled insulation displacement system comprises a first contact having a first insulation displacement slot therein having an open end and a closed end. The first insulation displacement slot has a first portion having a width adjacent the open end and a second portion having a width intermediate the first portion and the closed end, the first portion has a larger width than the second portion. The insulation displacement system further comprises a second contact, which includes a second insulation displacement slot therein having an open end and a closed end. The second insulation displacement slot has a first portion having a width adjacent the open end and a second portion having a width intermediate the first portion and the closed end, the first portion has a smaller width than the second portion.

46 Claims, 7 Drawing Sheets

U.S. PATENT DOCUMENTS

| | | | |
|---|---|---|---|
| RE35,325 | E | 9/1996 | Wass et al. |
| 5,556,296 | A | 9/1996 | Dussausse et al. |
| 5,575,689 | A | 11/1996 | Baggett et al. |
| 5,664,963 | A | 9/1997 | Yamamoto et al. |
| 5,762,518 | A | 6/1998 | Tanigawa et al. |
| 5,785,548 | A | 7/1998 | Capper et al. |
| 5,797,759 | A | 8/1998 | Mattis et al. |
| 5,836,791 | A | 11/1998 | Waas et al. |
| 5,967,826 | A | 10/1999 | Letailleur |
| 6,015,312 | A | 1/2000 | Escane |
| 6,089,902 | A | 7/2000 | Daoud |
| 6,099,343 | A | 8/2000 | Bonvallat et al. |
| 6,152,760 | A | 11/2000 | Reeser |
| 6,159,036 | A | 12/2000 | Daoud |
| 6,188,560 | B1 | 2/2001 | Waas |
| 6,193,556 | B1 | 2/2001 | Escane |
| 6,222,717 | B1 | 4/2001 | Waas et al. |
| 6,254,420 | B1 | 7/2001 | Letailleur et al. |
| 6,254,421 | B1 | 7/2001 | Denovich et al. |
| 6,406,324 | B1 | 6/2002 | Duesterhoeft et al. |
| 6,582,247 | B1 | 6/2003 | Siemon |
| 6,604,956 | B1 | 8/2003 | Ruiz et al. |
| 6,676,430 | B1 | 1/2004 | Conorich |
| 6,811,430 | B1 | 11/2004 | Carrico et al. |
| 6,893,280 | B1 | 5/2005 | Thompson et al. |
| 2002/0094715 | A1 | 7/2002 | Pepe et al. |
| 2003/0049961 | A1 | 3/2003 | Tricaud et al. |
| 2003/0156389 | A1 | 8/2003 | Busse et al. |

FOREIGN PATENT DOCUMENTS

| | | | |
|---|---|---|---|
| DE | 43 19 565 | C1 | 7/1994 |
| EP | 0 073 740 | B1 | 6/1985 |
| EP | 0 310 339 | A2 | 4/1989 |
| EP | 0 271 413 | B1 | 5/1992 |
| EP | 0 778 637 | A2 | 6/1997 |
| EP | 0 718 915 | B1 | 7/1997 |
| EP | 0 878 866 | A2 | 11/1998 |
| FR | 2 730 096 | A1 | 8/1996 |
| GB | 2 129 628 | A | 5/1984 |
| GB | 2 149 231 | A | 6/1985 |
| GB | 2 293 696 | A | 4/1996 |
| WO | WO 99/04454 | | 1/1999 |
| WO | WO 99/04455 | | 1/1999 |
| WO | WO 01/57957 | A1 | 8/2001 |

OTHER PUBLICATIONS

U.S. Appl. No. 29/213,197; Xavier Fasce et al, filed Sep. 15, 2004, entitled "Cap for Electrical Connector".

Technical Report, "3M 4500 Modular Terminating System", Oct. 1993.

U.S. Appl. No. 11/131,639, Dower et al, filed May 18, 2005, entitled Electrical Connector Assembly and Method of Forming the Same.

U.S. Appl. No. 11/131,874, Hills et al, filed May 18, 2005, entitled "Frame Assembly".

U.S. Appl. No. 11/170,956, Pratt, filed Jun. 30, 2005, entitled Apparatus Configured to Attach to an Electrical Connector Block.

U.S. Appl. No. 11/196,229, Pratt, filed Aug. 3, 2005, entitled "Circuit Marker Apparatus".

U.S. Appl. No. 10/941,441; Xavier Fasce et al, filed Sep. 15, 2004, entitled "Connector Assembly for Housing Insulation Displacement Elements".

U.S. Appl. No. 29/213197; Xavier Fasce et al, filed Sep. 15, 2004, entitled "Cap For Electrical Connector".

* cited by examiner

INSULATION DISPLACEMENT SYSTEM FOR TWO ELECTRICAL CONDUCTORS

FIELD

The present invention relates to electrical contacts. In one particular aspect, the present invention relates to an insulation displacement element within a connector assembly for use in making an electrical connection with an electrical element.

BACKGROUND

In a telecommunications context, connector blocks are connected to cables that feed subscribers while other connector blocks are connected to cables to the central office. To make the electrical connection between the subscriber block and the central office block, jumper wires are inserted to complete the electrical circuit. Typically jumper wires can be connected, disconnected, and reconnected several times as the consumer's needs change.

An insulation displacement connector, or IDC, element is used to make the electrical connection to a wire or electrical conductor. The IDC element displaces the insulation from a portion of the electrical conductor when the electrical conductor is inserted into a slot within the IDC element so the IDC element makes electrical connection to the electrical conductor. Once the electrical conductor is inserted within the slot with the insulation displaced, electrical contact is made between the conductive surface of the IDC element and the conductive core of the electrical conductor.

Occasionally, it may be desirable to place a second electrical conductor within an IDC element to make the jumper connection. However, when the IDC element has a single, uniform slot, a greater force is required to insert the second wire because the first wire encounters significant resistance when inserted further into the slot. Additionally, when the first wire is inserted further into the slot, undesirable bending outward of the IDC element may occur. The outward bending may interfere with making a proper connection between the IDC element and second electrical conductor.

BRIEF SUMMARY

The present invention provides an electrically coupled insulation displacement system. The electrically coupled insulation displacement system comprises a first contact and a second contact. The first contact includes a first insulation displacement slot therein having an open end and a closed end. The first insulation displacement slot has a first portion having a width adjacent the open end and a second portion having a width intermediate the first portion and the closed end, the first portion has a larger width than the second portion. The second contact includes a second insulation displacement slot therein having an open end and a closed end. The second insulation displacement slot has a first portion having a width adjacent the open end and a second portion having a width intermediate the first portion and the closed end, the first portion has a smaller width than the second portion.

While the above-identified figures set forth several embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the spirit and scope of the principals of this invention. The figures may not be drawn to scale. Like reference numbers have been used throughout the figures to denote like parts.

DETAILED DESCRIPTION

Figure 1:
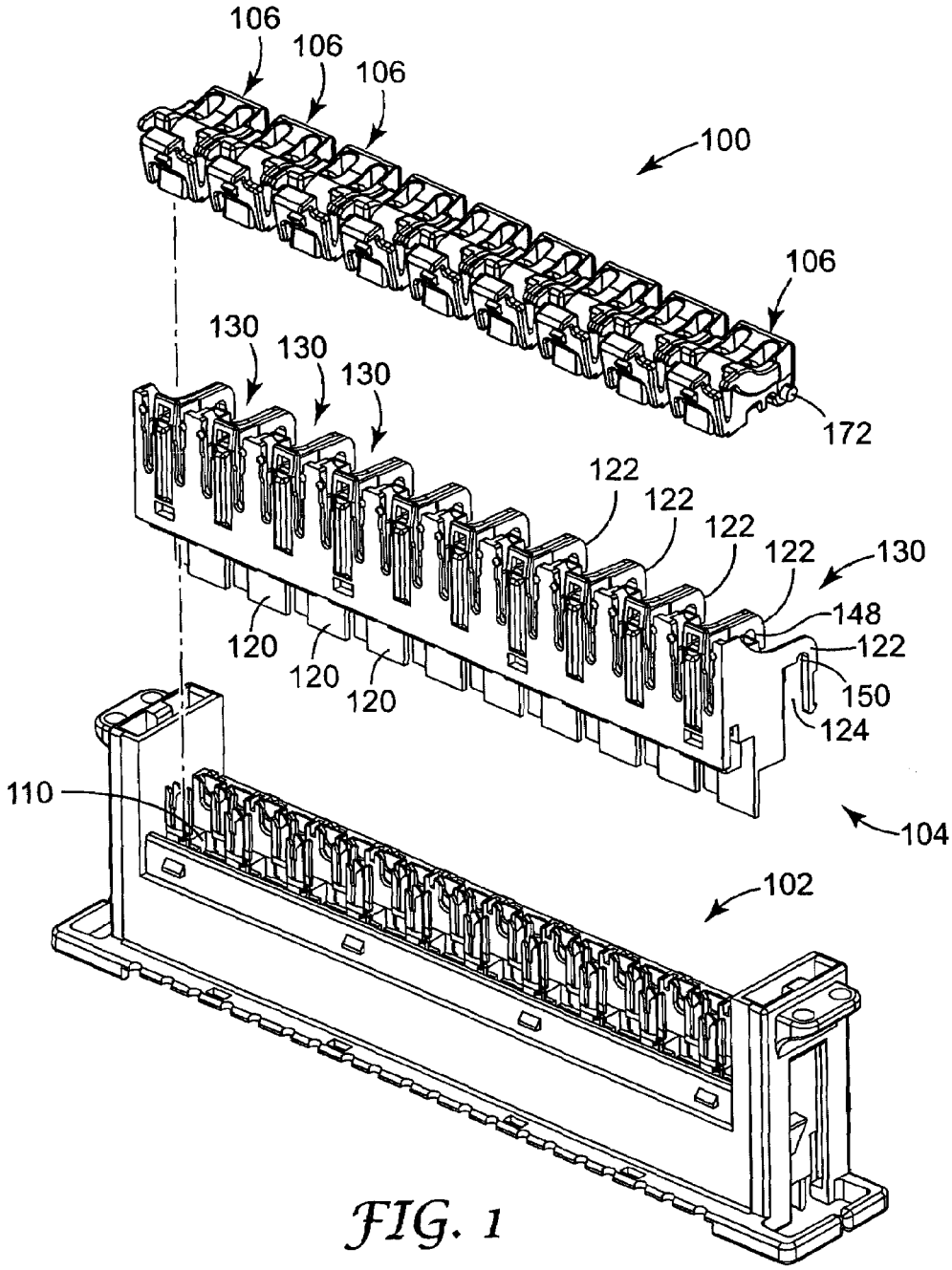
FIG. 1 is an exploded perspective view of a connector assembly of the present invention.

FIG. 1 is an exploded perspective view of an IDC connector assembly 100 of the present invention. The connector assembly 100 comprises a base unit 102, a connector unit 104, and a plurality of caps 106. In FIG. 1, the connector assembly 100 is shown disassembled. To assemble the connector assembly 100, the caps 106 are inserted in between lock projections 122 projecting from a rear side of the connector unit 104 and then the connector unit 104 is placed over and slid into the base unit 102.

The base unit 102 comprises an insulated housing with a series of receiving slots 110 for connection with the connector unit 104. Lock slots on a rear side of the base unit 102 receive lock projections 122 of the connector unit 104 to lock the connector unit 104 to the base unit 102.

Figure 11:
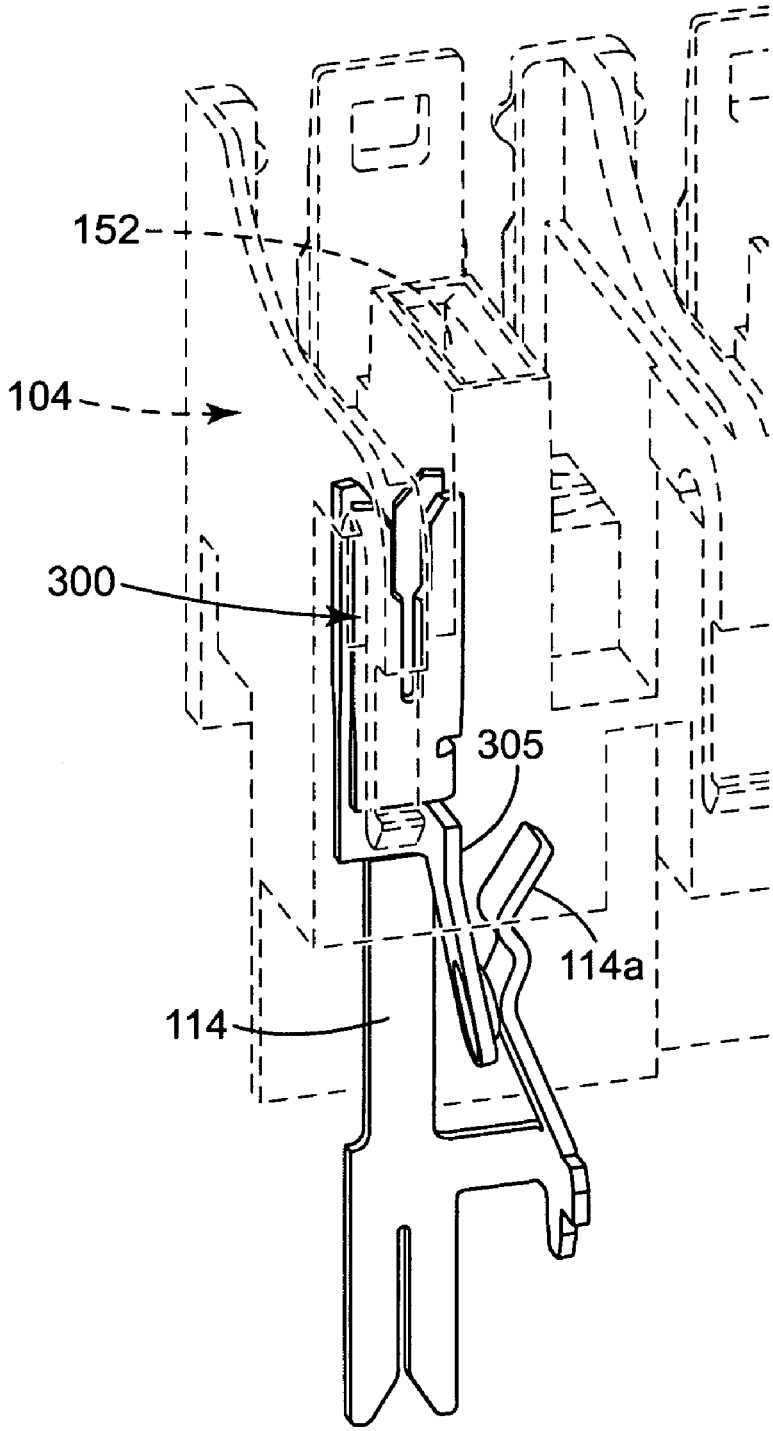
FIG. 11 is a perspective view through the connector unit (shown in phantom) showing the connection between the insulation displacement element and an electrical element.
Figure 12:
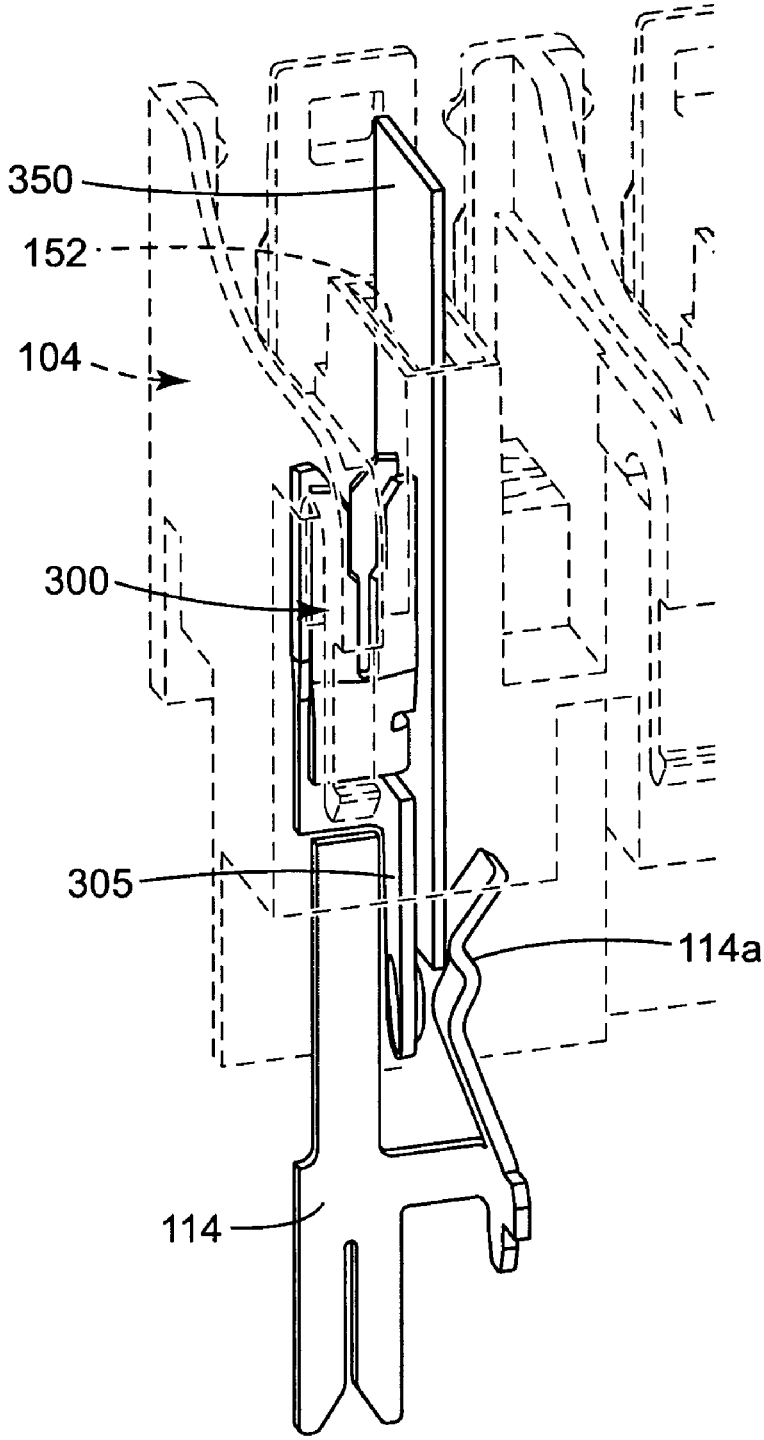
FIG. 12 is a perspective view through the connector unit (shown in phantom) showing a test probe inserted between the connection of the insulation displacement element and its respective electrical element.

Located within the base unit 102 are a plurality of electrical elements 114 (see FIG. 11 and FIG. 12). Each electrical element 114 is in the form of an IDC element, and is adapted to make electrical contact with a corresponding IDC element in the connector assembly 100, as explained below.

The connector unit 104 comprises an insulated housing with a series of alignment projections 120 for connection into the receiving slots 110 of the base unit 102. The lock projections 122 project outwardly and downwardly from the rear side of the connector unit 104 and lock within the lock slots on the rear side of the base unit 102 to lock the connector unit 104 to the base unit 102.

Each cap 106 is independently pivotally mounted onto the connector unit 104, relative to a respective housing 130. Each cap 106 comprises a first pivot projection 170 and a second coaxial pivot projection 172 (see FIG. 3) opposite the first pivot projection 170, which enter and engage with the connector unit 104 at a gap 124 created between adjacent lock projections 122, as they project outwardly and downwardly from the rear side of the connector unit 104. For assembly, the pivot projections 170, 172 of the cap 106 are first inserted within the gap 124 and connected to the connector unit 104 prior to the connector unit 104 being attached to the base unit 102. Once the connector unit 104 is attached and locked within the base unit 102, the first and second pivot projections 170, 172 of the cap 106 are secured within hinge slots 148, 150, respectively, on adjacent lock projections 122, and within the gap 124 to prevent the cap 106 from being removed. However, the pivot projections 170, 172 allow for pivoting movement of the cap 106 relative to the connector unit 104, within the hinge slots 148, 150.

The connector unit 104 shown in FIG. 1 comprises a plurality of housings 130 and associated caps 106. A separate cap 106 is provided to cover each housing 130. Each connector assembly 100 is a self-contained unit, insulated from the next adjacent connector assembly 100. However, the connector assembly 100 may comprise any number of housings 130, base units 102, and caps 106. Each housing 130, base unit 102 and cap 106 form an assembly that is adapted to receive at least one pair of electrical conductors, as explained below. Because the connector assembly 100 may comprise any number of housings 130, base units 102, and caps 106 there can be any number of a pair of electrical conductors, such as but not limited to one, 5, 10, or 50 pairs.

The connector assembly 100 may be constructed, for example, of an engineering plastic such as, but not limited to: Valox® 325 a polybutylene terephthalate (PBT) polymer, available from GE Plastics of Pittsfield, Mass.; Lexan® 500R a polycarbonate resin, flame retardant, 10% glass fiber reinforced grade available from GE Plastics of Pittsfield, Mass.; Mackrolon® 9415 a polycarbonate resin, flame retardant, 10% glass fiber reinforced grade available from Bayer Plastics Division of Pittsburgh, Pa.; or Mackrolon® 9425 a polycarbonate resin, flame retardant, 20% glass fiber reinforced grade available from Bayer Plastics Division of Pittsburgh, Pa.

The caps 106 may be constructed, for example, of an engineering plastic such as, but not limited to: Ultem® 1100 a polyether imide resin available from GE Plastics of Pittsfield, Mass.; Valox® 420 SEO a polybutylene terephthalate (PBT) resin flame retardant, 30% glass fiber reinforced available from GE Plastics of Pittsfield, Mass.; IXEF® 1501 a polyarylamide resin, flame retardant, 30% glass fiber reinforced grade available from Solvay Advanced Polymers, LLC of Alpharetta, Ga.; or IXEF® 1521 a polyarylamide resin, flame retardant, 50% glass fiber reinforced grade available from Solvay Advanced Polymers, LLC of Alpharetta, Ga.

Figure 2:
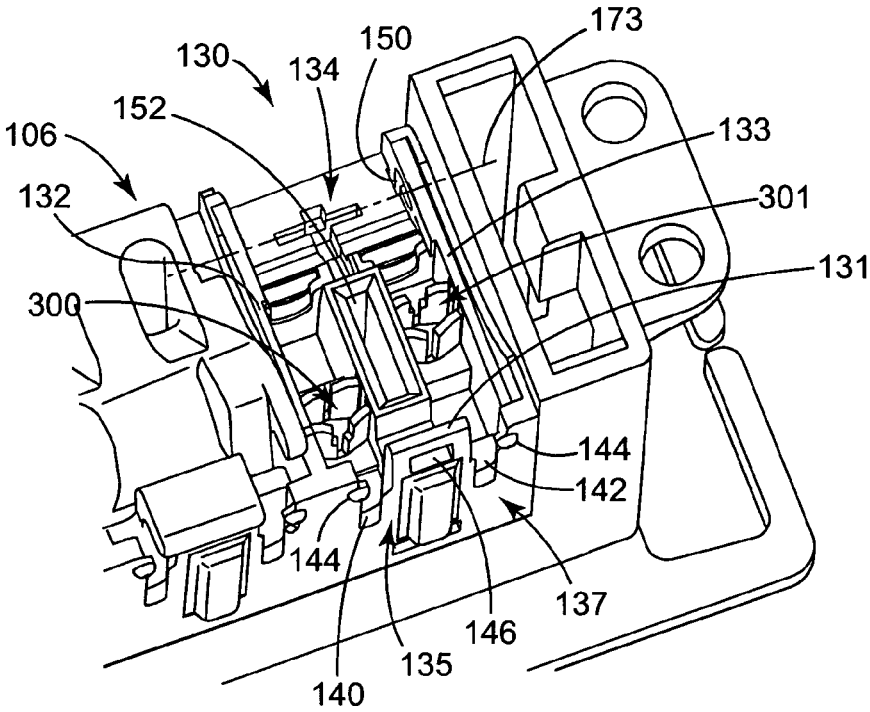
FIG. 2 is an assembled perspective view of a portion of the connector assembly of the present invention, with one of a plurality of pivoting caps removed for clarity of illustration.

FIG. 2 is an assembled perspective view of a portion of the connector assembly 100 of the present invention, with one of the pivoting caps 106 omitted to show the internal configuration and components of one of the housings 130. Also, electrical conductors (i.e., wire), which would otherwise be in the housing 130 when fully assembled for operation, have been omitted to show the internal configuration and components of the housing 130.

Each housing 130 comprises a front wall 131, a first side wall 132, a second side wall 133, and a base 134. The housing 130 is formed to have a first section 135 and a second section 137. Separating the first section 135 from the second section 137 is a test probe slot 152.

Figure 3:
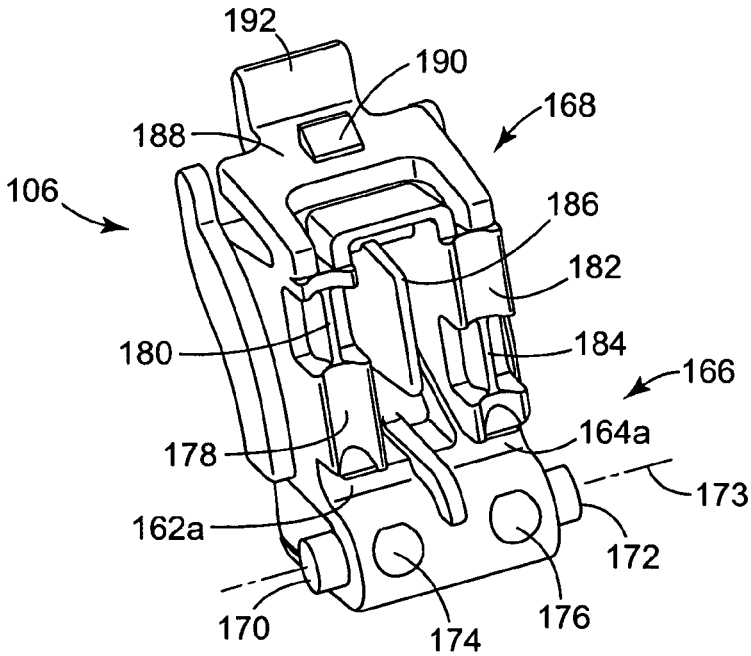
FIG. 3 is a perspective view of the underside of one of the caps.
Figure 4:
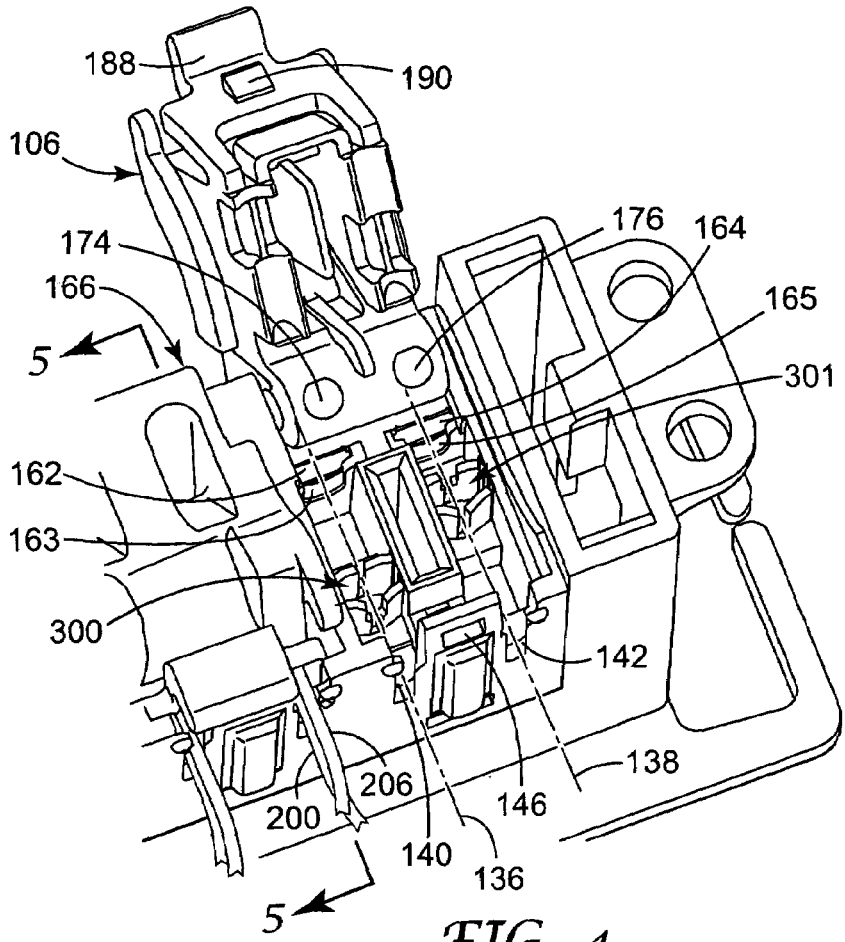
FIG. 4 is a perspective view of a portion of the assembled connector unit, showing one of the caps in a pivoted open position.

Along the front wall 131 is a first wire groove 140 and a second wire groove 142, which allow entry of the electrical conductors into the housing 130 (see FIG. 4). Wire retainer projections 144 extend laterally into the grooves 140 and 142 to resiliently hold the electrical conductors within the first wire groove 140 and second wire groove 142, and prevent the electrical conductors from moving out of the open end of the grooves 140, 142. A latch opening 146 is disposed on the front wall 131, which is capable of receiving a latch projection 190 (see FIG. 3) on the cap 106 to lock the cap 106 to the front wall 131 of the housing 130 and prevent the cap 106 from accidentally opening (see FIG. 4).

Along the first side wall 132 is a first hinge slot 148, and along the second side all 133 is a second hinge slot 150 (see FIGS. 1 and 2). Each hinge slot 148, 150 is created by a portion of the gap 124 of the lock projections 122 extending out and down from the housing 130. The hinge slots 148, 150 pivotally receive the pivot projections 170, 172 extending laterally from the cap 106 to allow the cap 106 to pivot along a pivot axis 173 (see FIGS. 2 and 3).

The base 134 of the housing 130 includes the test probe slot 152, that essentially separates the first section 135 of the housing 130 from the second section 137 of the housing 130. The test probe slot 152 may be divided into two portions with the first allowing for testing of the electrical connections on the first section 135 of the housing 130 and the second allowing for testing of the electrical connections on the second section 137 of the housing 130. Test probes as are known in the art are inserted into the test probe slot 152 (see, e.g., FIG. 12).

As seen in FIG. 2, extending from the base 134 of the first section 135 of the housing 130 is a first IDC element 300, and extending from the base 134 of the second section 137 of the housing 130 is a second IDC element 301. Each IDC element 300, 301 is conductive and capable of displacing the insulation from electrical conductors to electrically couple the conductive cores of the electrical conductors to the IDC elements. For example, the IDC elements 300, 301 may be constructed of phosphor bronze alloy C51000 per ASTM B103/103M-98e2 with reflowed matte tin plating of 0.000150–0.000300 inches thick, per ASTM B545-97(2004) e2 and electrodeposited nickel underplating, 0.000050 inches thick minimum, per SAE-AMS-QQ-N-290 (July 2000).

FIG. 3 is a perspective view of the underside of the cap 106. The cap 106 includes a pivot portion 166 and a cover portion 168. Extending laterally from the pivot portion 166 are the first pivot projection 170 and second pivot projection 172. The pivot projections 170, 172 engage with the hinge slots 148, 150 of the side walls 132, 133 of the housing 130 to secure the cap 106 to the housing 130 while allowing for pivoting movement of the cap 106 along the pivot axis 173.

Extending into the pivot portion 166 is a first recess 174 and second recess 176. The recesses 174, 174 may be a through hole extending through the entire pivot portion 166 of the cap 106, or may extend through only a portion of the pivot portion 166 of the cap 106. The first recess 174 is aligned with the first section 135 of the housing 130, and the second recess 176 is aligned with the second section 137 of the housing 130. Each recess 174, 176 receives electrical conductors passing through the housing 130. Although the first recess 174 and second recess 176 are shown as parallel recesses through the pivot portion 166, it is within the scope of the present invention that the first recess 174 and second recess 176 may not be parallel to one another.

The cover portion 168 of the cap 106 is movable from an open position (FIG. 4) to a closed position (e.g., FIG. 5) to cover the open top of the housing 130. Adjacent the pivot portion 166 of the cap 106 is a first indent 162*a* and a second indent 164*a*. A first wire hugger 178 and a first wire stuffer 180 are located on the underside of the cover portion 168, adjacent the first section 135 of the housing 130. A second wire stuffer 184 and a second wire hugger 182 are located on the cover portion 168 adjacent the second section 137 of the housing 130. When the cap 106 is closed, the underside of the cover portion 168 of the cap 106 engages the electrical conductor. The first wire hugger 178 and first wire stuffer 180 engage the upper exposed surface of the insulated electrical conductor. Upon complete closure of the cap 106, the first wire stuffer 180 (being aligned with the first IDC element 300) follows and pushes the electrical conductor into the first IDC element 300 (FIG. 4). A similar closing occurs at the second IDC element 301. However, because the second IDC element 301 is closer to the pivot axis 173 of the pivot portion 166 of the cap 106, the second wire stuffer 184 is arranged on the cap 106 accordingly (i.e., the positions of the wire stuffers 180, 184 are staggered radially relative to the pivot axis 173). Extending through the center of the cover portion 168 is a test probe slot cap 186, which partially enters the test probe slot 152 when the cap 106 is closed.

A resilient latch 188, which is capable of flexing relative to the cover portion 168 of the cap 106, is located on the cover portion 168 of the cap 106. When the cap 106 is closed, the resilient latch 188 flexes so that the latch projection 190 on the resilient latch 188 can enter the latch opening 146 on the front wall 131 of the housing 130. When the latch projection 190 is engaged with the latch opening 146, the cap 106 is secured to the housing 130 and will not open. To open the cap 106, a release lever 192 on the resilient latch 188 is pressed rearwardly to disengage the latch projection 190 from the latch opening 146. Then, the cap 106 can be pivoted open, as shown in FIG. 4, for access to the cavity within the housing 130 and electrical conductors and IDC elements therein.

FIG. 4 is a perspective view of the connector unit 104 showing a housing 130 with the cap 106 attached and in an open position. Again, the electrical conductors have been omitted in FIG. 4 to show the internal configuration and components of the housing 130. However, first and second electrical conductors 200, 206 can be seen extended from the adjacent housing.

The first IDC element 300 and a first blade 162 is located at the base 134 of the first section 135 of the housing 130. The first blade 162 is located adjacent the pivot portion 166 of the cap 106. A first support 163 is shaped to support and cradle an electrical conductor when inserted into the housing 130. The first support 163 is positioned in front of the first blade 162 to provided structural support to the blade 162. When the cap 106 is closed and pressing down on the electrical conductor, the first support 163 supports the electrical conductor so that the first blade 162 can properly and effectively cut the electrical conductor. Then, the first blade 162 enters the first indent 162*a* on the cap 106.

The second IDC element 301 and a second blade 164 is located at the base 134 of the second section 137 of the housing 130. The second blade 164 is located adjacent the pivot portion 166 of the cap 106. A second support 165 is shaped to support and cradle an electrical conductor when inserted into the housing 130. The second support 165 is positioned in front of the second blade 164 to provided structural support to the blade 164. When the cap 106 is closed and pressing down on the electrical conductor, the second support 165 supports the electrical conductor so that the second blade 164 can properly and effectively cut the electrical conductor. Then, the second blade enters the second indent 164*a* on the cap 106.

Figure 5:
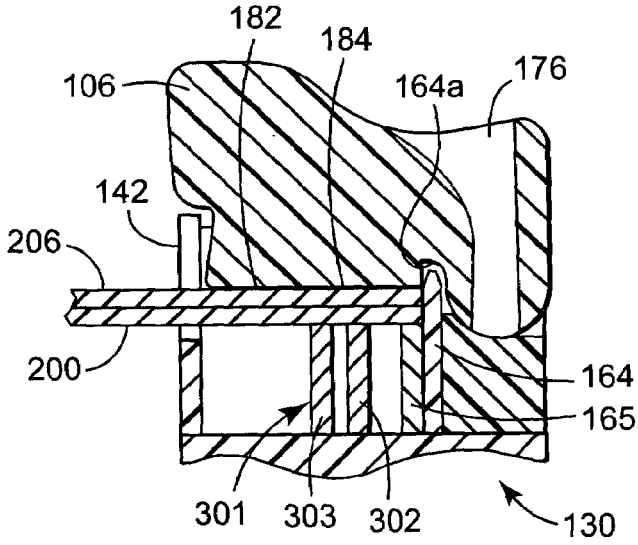
FIG. 5 is a schematic sectional view through the housing, as taken along line 5—5 in FIG. 4.

The first blade 162 and second blade 164 may be constructed of a metallic material and have a slightly sharpened edge, as is more clearly shown in FIG. 5. For example, the blades may be constructed of stainless steel alloy S30100, full hard temper, per ASTM A666-03. In addition, the blades 162, 164 may be constructed as a component extending from the base 134 of the housing 130, and therefore be non-metallic. In such a case, the blades 162, 164 may also have a slightly sharpened edge, which creates a pinch point to cut the electrical conductors when the cap 106 is moved to a closed position.

It is preferable to insert a single electrical conductor into each section 135, 137 of the housing 130 and into the recesses 174, 176, respectively, to be cut by the blades 162, 164, respectively. However, in some instances two electrical conductors may be inserted into each section 135, 137 of the housing 130 and into the recesses 174, 176, respectively, to be cut by the blades 162, 164, respectively. Further, the first blade 162 and second blade 164 shown in FIG. 4 are symmetrically arranged within the housing 130. However, the first and second blades 162, 164 may be staggered (radially displaced relative to pivot axis 173) or may have different heights relative to the base 134 of the housing 130. By either staggering the blades 162, 164 or varying the heights of the blades 162, 164, it is possible to vary the sequencing of cutting the electrical conductors, thereby minimizing the force needed to close the cap 106 and cut the electrical conductors.

FIG. 4 shows the linear arrangement of the first IDC element 300 on the first section 135 of the housing 130 and the second IDC element 301 on the second section 137 of the housing 130. As can be seen, the first wire groove 140, first IDC element 300, first support 163, first blade 162, and first recess 174 in the cap 106 are generally linearly arranged along a first plane 136 within the first section 135 of the housing 130. Within the second section 137 of the housing 130, the second wire groove 142, second IDC element 301, second support 165, second blade 164, and second recess 176 in the cap 106 are generally linearly arranged along a second plane 138. Relative to the pivot axis 173 of the cap 106, the first IDC element 300 and the second IDC element 301 are off-set (i.e., radially staggered) from one another along their respective planes, 136, 138. As shown, the second IDC element 301 is closer to the pivot portion 166 of the cap 106 than the first IDC element 300.

Staggering the first IDC element 300 and second IDC element 301 minimizes the force needed to be applied to the cap 106 to properly close the cap 106 and engage all electrical conductors in each IDC element, because the electrical conductors are not being forced into their respective IDC elements at the same time during closure. Instead, the electrical conductor for the IDC element closest to the pivot portion 166 of the cap 106 (IDC element 301) is pressed into engagement first, and the electrical conductor at the IDC element farthest from the pivot portion 166 of the cap 106 (IDC element 300) is pressed into engagement last. Further, the cutting of the electrical conductors during cap closure (at each blade 162, 164) can occur during insertion but prior to final insertion is reached or can occur before the electrical conductors are inserted into their respective IDC elements 301, 300, which further minimizes the forces needed to close the cap 106 while making the proper connections.

Although the first IDC element 300 and second IDC element 301 are shown staggered relative to the pivot axis 173, the first IDC element 300 and second IDC element 301 may be uniformly arranged within the housing. Further, the first IDC element 300 and second IDC element 301 may have different heights relative to the base 134 of the housing 130 such that electrical conductors will first be inserted in to the higher IDC element, and then into the lower IDC element. Again, this sequencing of inserting the electrical conductors into the IDC elements minimizes the forces needed to close the cap 106 while making the proper connections.

Further description of the housing and insertion of the electrical conductors within the IDC is described in U.S. patent application 10/941,441 titled "CONNECTOR ASSEMBLY FOR HOUSING INSULATION DISPLACEMENT ELEMENTS" filed on even date herewith, the disclosure of which is hereby incorporated by reference.

FIG. 5 is a schematic sectional view through the second section 137 of one of the housings 130, as taken along line 5—5 in FIG. 4. The cap 106 is closed such that the second wire stuffer 184 has pressed a first lower electrical conductor 200 and a second upper electrical conductor 206 into engagement with a first contact 302 and a second contact 303 of the second IDC element 301. As seen, the second wire hugger 182 is in contact with an upper surface of the second electrical conductor 206. The first electrical conductor 200 and second electrical conductor 206 are resting on the second support 165, which supports the conductors 200, 206 when they are cut. The second blade 164 has cut the first electrical conductor 200 and second electrical conductor 206 such that those portions of the first and second electrical conductor 200, 206 passing through the second recess 176 in the cap 106 have been detached. With the cap 106 closed, the second blade 164 has entered indent 164*a*. A user is able to contact an end of the cut electrical conductors 200, 206 passing through the recess 176 and brush the cut portion out of the recess 176 to discard. The portions of the first electrical conductor 200 and second electrical conductor 206 opposite the cut end extend out of the housing 130 through the second wire groove 142.

Although FIG. 5 was described with respect to the second section 137 of one of the housings 130, it is understood that electrical conductors 200, 206 passing through the first section 135 of one of the housings 130 would make a similar contact with the first IDC element 300. However, as is understood from the configuration of the IDC element arrangement of FIGS. 2 and 4, the first IDC element 300 may be positioned further from the first recess 174 in the cap 106 than the second IDC element 301 is positioned with respect to the second recess 176 in the cap 106. Therefore, the first wire hugger 178 and first wire stuffer 180 would be positioned (e.g., staggered) accordingly.

Figure 6:
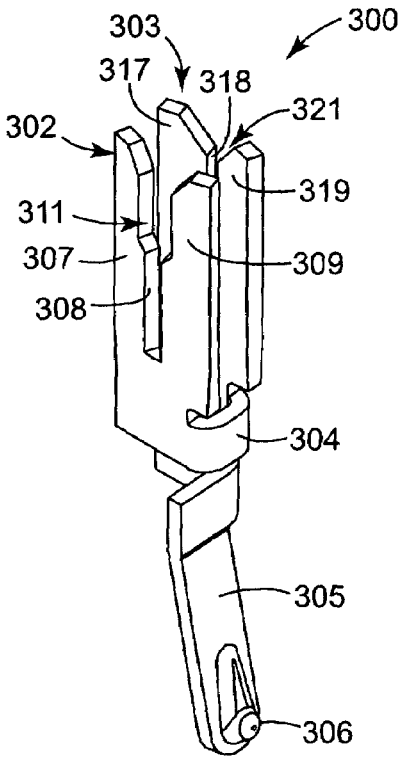
FIG. 6 is a perspective view of the insulation displacement element of the present invention.

FIG. 6 is a perspective view of the first IDC element 300 of the present invention. The first IDC element 300 includes the first contact 302 and the second contact 303, which are electrically connected to one another by a bridging section 304.

Extending below and biased from the bridging section 304 is a resilient tail 305. A raised tab 306 projecting from the tail 305 helps make an electrical connection to another electrical element. When the first IDC element 300 is placed in the first section 135 of the housing 130, the tail 305 extends in a direction towards the test probe slot 152 (see FIGS. 11 and 12).

Figure 7:
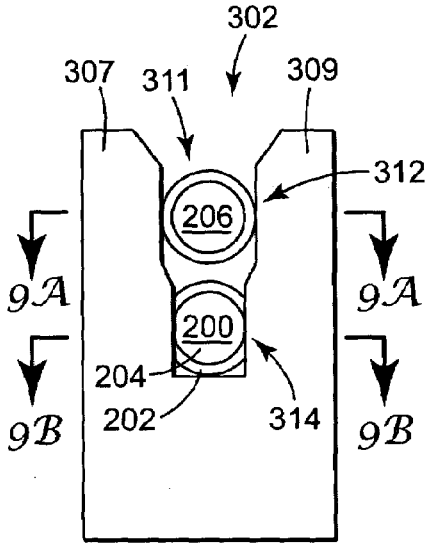
FIG. 7 is a front view of a U-shaped portion of a first contact of the insulation displacement element of the present invention.

As seen in FIG. 6 and FIG. 7, which is a front view of a portion of the first contact 302, the first contact 302 has a generally U-shape, including a first leg 307 with an inside slot edge 308 and a second leg 309 with an inside slot edge 310 (see FIGS. 9A and 9B) spaced from one another to form a first insulation displacement slot 311. The first insulation displacement slot 311 has a wide portion 312 and a narrow portion 314. At the wide portion 312 the inside edge 308 of the first leg 307 and the inside edge 310 of the second leg 309 are spaced farther from one another than at the narrow portion 314. For the first contact 302, the wide portion 312 is located adjacent the open end of the first insulation displacement slot 311, while the narrow portion 314 is located near a middle of the insulation displacement slot 311 or intermediate the wide portion 312 and the closed end of the first insulation displacement slot 311.

Figure 8:
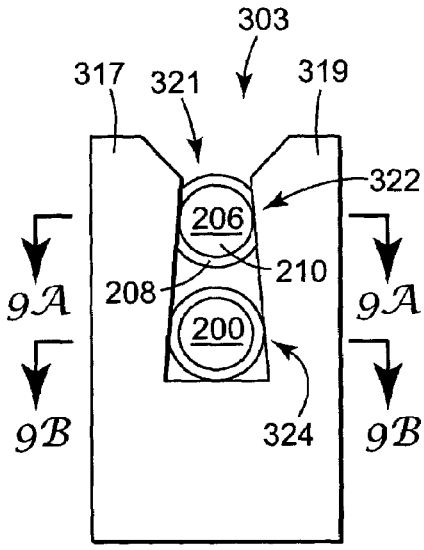
FIG. 8 is a front view of a U-shaped portion of a second contact of the insulation displacement element of the present invention.

As seen in FIG. 6 and FIG. 8, which is a front view of a portion of the second contact 303, the second contact 303 has a generally U-shape, including a first leg 317 with an inside slot edge 318 and a second leg 319 with an inside slot edge 320 (see FIGS. 9A and 9B) spaced from one another to form a second insulation displacement slot 321. The second insulation displacement slot 321 has a narrow portion 322 and a wide portion 324. At the narrow portion 322 the inside edge 318 of the first leg 317 and the inside edge 320 of the second leg 319 are spaced closer to one another than at the wide portion 324. For the second contact 303, the narrow portion 322 is located adjacent the open end of the second insulation displacement slot 321, while the wide portion 324 is located near a middle of the insulation displacement slot 321 or intermediate the narrow portion 322 and the closed end of the second insulation displacement slot 321.

Although not shown independently as in FIG. 6, the second IDC element 301 is similar to the first IDC element 300. However, its tail extends in the opposite direction. The tail of the second IDC element 301 extends towards the center to the test probe slot 152. The wide portions and narrow portions in the first and second contacts of the second IDC element 301 may be configured in reverse order, relative to the first IDC element 300 (as considered from a radial perspective relative to the pivot axis 173).

In use, the first electrical conductor 200 is placed within the first section 135 of the housing and into the first recess 174. The first electrical conductor is first inserted into the insulation displacement slots 311 and 321 of the first and second contacts 302, 303, respectively, by closing the cap 106. The first electrical conductor 200 first rests within and makes contact with the narrow portion 322 of the second insulation displacement slot 321 and passes through the wide portion 312 of the first insulation displacement slot 311. Inside slot edges 318 and 320 of the first leg 317 and second leg 319 of the second contact 303 displace a portion of an insulation sheath 202 covering the first electrical conductor 200 such that the conductive core 204 of the first electrical conductor 200 electrically contacts the legs 317, 319 of the second contact 303. However, the first IDC element 300 is capable of supporting two electrical conductors. FIGS. 7 and 8 show two electrical conductors 200, 206 in place.

After the first electrical conductor 200 is inserted into the insulation displacement slots 311 and 321, the second electrical conductor 206 is inserted within the first section 135 of the housing 130 and on top of the first electrical conductor 200, which is already in contact with the first and second contacts 302, 303. The first electrical conductor 200 is thus pressed further down into the insulation displacement slots 311 and 321 such that the first electrical conductor 200 makes contact with the narrow portion 314 of the first insulation displacement slot 311 and passes through the wide portion 324 of the second insulation displacement slot 321. Inside slot edges 308 and 310 of the first leg 307 and second leg 309 of the first contact 302 displace a portion of the insulation sheath 202 covering the first electrical conductor 200 such that the conductive core 204 now electrically contacts the legs 307, 309 of the first contact 302.

As the second electrical conductor 206 is inserted into insulation displacement slots 311 and 321, pressing the first electrical conductor 200 downward, the second electrical conductor 206 makes contact with the narrow portion 322 of the second insulation displacement slot 321 and passes through the wide portion 312 of the first insulation displacement slot 311. Inside slot edges 318 and 320 of the first leg 317 and second leg 319 of the second contact 303 displace a portion of an insulation sheath 208 covering the second electrical conductor 206 such that the conductive core 210 electrically contacts the legs 317, 319 of the second contact 303.

It is preferable that the first electrical conductor 200 is inserted into the contacts 302, 303 first. Then, once inserted, the cap 106 is reopened and the second electrical conductor 206 is inserted into the contacts 302, 303. However, it maybe possible to insert both the first electrical conductor 200 and second electrical conductor 206 simultaneously with the cap 106.

The wide portion 312 of the first contact 302 creates a larger space for the second electrical conductor 206 to enter. This wide portion 312 prevents stresses within the first contact 302 from exerting a force, which may bend the first leg 307 and second leg 309 outward and may minimize contact between the conductive core 204 of the first conductor 200 and the legs 307, 309. Similarly, the wide portion 324 of the second contact 303 creates a larger space for the first electrical conductor 200 to enter when pressed downward by the second electrical conductor 206. This wide portion 324 prevents stresses within the second contact 303 from exerting a force, which may bend the first leg 317 and second leg 319 outward and may minimize contact between the conductive core 210 of the second conductor 206 and the legs 317, 319. Even in cases of very large or very small electrical conductors, the wide portions 312, 324 will tend to minimize the tendency of stressing within the first and second contacts 302, 303, which may ultimately effect the electrical connections made between the contacts 302, 303 and the electrical conductors 200, 206.

The narrow portion 314 of the first contact 302 creates a small space for the first electrical conductor 200 such that even if electrical contact is not made at the wide portion 324 of the second contact 303, contact will be made with the first electrical conductor 200 at the narrow portion 314 of the first contact 302. Further, even if bending occurs in the first contact 302, because the first electrical conductor 200 is within the narrow portion 314, the second electrical conductor 206 makes electrical contact at the narrow portion 322 of the second contact 303.

Figure 9A:
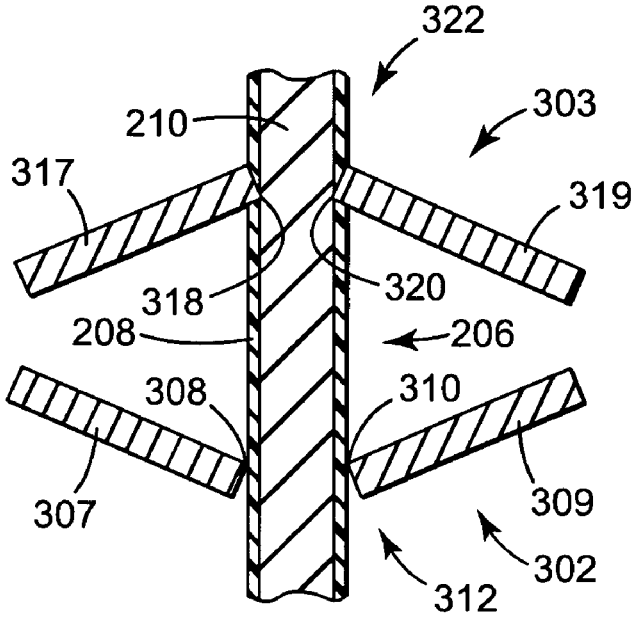
FIG. 9A is a sectional view as taken along lines 9A—9A in FIGS. 7 and 8, showing a second electrical conductor inserted into the insulation displacement slots of the contacts.

FIG. 9A is a sectional view as taken along lines 9A—9A in FIGS. 7 and 8, showing a second electrical conductor 206 inserted into the insulation displacement slots 311, 321 of the contacts 302, 303. The first leg 307 and second leg 309 of the first contact 302 are angled symmetrically such that an inside edge 308 on the first leg 307 and an inside edge 310 on the second leg 309 form. Also, the first leg 317 and second leg 319 of the second contact 303 are angled symmetrically, however opposite to the first contact 302, such that an inside edge 318 on the first leg 317 and an inside edge 320 on the second leg 319 form. At the narrow portion 322 of the second contact 303, the conductive core 210 of the second electrical conductor 206 makes electrical contact with the first and second legs 317, 319 of the second contact 303. At the narrow portion 322, inside slot edge 318 of the first leg 317 and inside slot edge 320 of the second leg 319 on the second contact 303 each create an edge capable of displacing a portion of the insulation sheath 208 covering the conductive core 210 of the second electrical conductor 206.

Figure 9B:
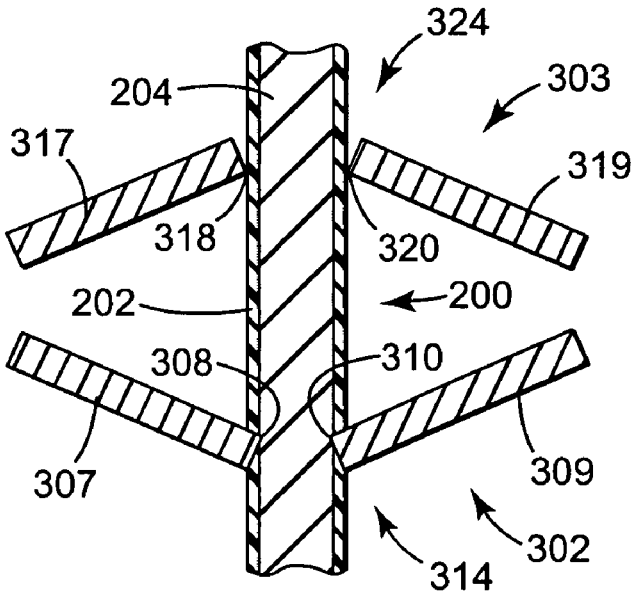
FIG. 9B is a sectional view as taken along lines 9B—9B in FIGS. 7 and 8, showing a first electrical conductor inserted into the insulation displacement slots of the contacts.

FIG. 9B is a sectional view as taken along lines 9B—9B in FIGS. 7 and 8, showing a first electrical conductor 200 inserted into the insulation displacement slots 311, 321 of the contacts 302, 303. The first leg 307 and second leg 309 of the first contact 302 are angled symmetrically such that an inside edge 308 on the first leg 307 and an inside edge 310 on the second leg 309 form. Also, the first leg 317 and second leg 319 of the second contact 303 are angled symmetrically, however opposite to the first contact 302, such that an inside edge 318 on the first leg 317 and an inside edge 320 on the second leg 319 form. At the narrow portion 314 of the first contact 302, the conductive core 204 of the first electrical conductor 200 makes electrical contact with the first and second legs 307, 309 of the first contact 302. At the narrow portion 314, inside slot edge 308 of the first leg 307 and inside slot edge 310 of the second leg 309 on the first contact 302 each create an edge capable of displacing a portion of the insulation sheath 202 covering the conductive core 204 of the first electrical conductor 200.

The inside slot edges reduce the forces necessary to insert the electrical conductors within the first contact 302 and second contact 303. The inside slot edges may be formed on both legs, as shown in FIGS. 9A and 9B, or may be formed on one leg. Also, the inside slot edges may extend the entire length of the first and second insulation displacement slots 311 and 321, as shown in FIGS. 9A and 9B, or may just be provided at the narrow portion 314 of the first contact 302 and the narrow portion 324 of the second contact 303, because it is the narrow portion where the electrical contact is made between the contact and electrical conductor. As shown, the inside slot edges are a sharp edge having nearly a 90 degree angle. However, the slot edges may be curved or slightly rounded.

The first leg 307 and second leg 309 of the first contact 302 is shown as angled opposite to the first leg 317 and second leg 319 of the second contact 303. However, the legs 307, 309 of the first contact 302 and legs 317, 319 of the second contact may be angled in any suitable orientation to create one or two inside slot edges.

Once the first and second electrical conductors 200, 206 are inserted within the first and second contacts 302, 302 as shown in FIGS. 7, 8, 9A, and 9B, the electrical conductors 200, 206 are electrically coupled to the contacts 302, 302. Further, the electrical conductors 200, 206 are electrically coupled to one another.

Any standard telephone jumper wire with PCV insulation may be used as the electrical conductor. The wires may be, but are not limited to: 22 AWG (round tinned copper wire nominal diameter 0.025 inches (0.65 mm) with nominal PVC insulation thickness of 0.0093 inches (0.023 mm)); 24 AWG (rounded tinned copper wire nominal diameter 0.020 inches (0.5 mm) with nominal PVC insulation thickness of 0.010 inches (0.025 mm); 26 AWG (rounded tinned copper wire nominal diameter 0.016 inches (0.4 mm) with nominal PVC insulation thickness of 0.010 inches (0.025 mm).

Figure 10:
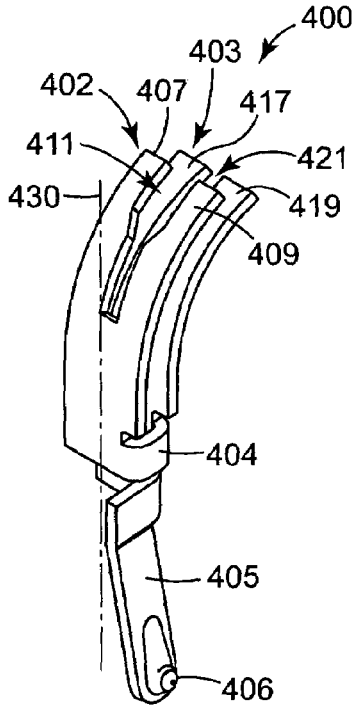
FIG. 10 is a perspective view of an alternative embodiment of the inventive insulation displacement element.

FIG. 10 is a perspective view of an alternative embodiment of the inventive insulation displacement element. An alternative IDC element 400 includes a first contact 402 and a second contact 403 electrically connected to one another at a bridge 404. Extending below the bridge 404 is a tail 405 with a tab 406 for making contact with another electrical element.

The first contact 402 includes a first leg 407 and a second leg 409 separated from one another to form a first insulation displacement slot 411. The second contact 403 includes a first leg 417 and a second leg 419 separated from one another to form a second insulation displacement slot 421. The first insulation displacement slot 411 and second insulation displacement slot 421 may have wide portions and narrow portions similar to the first IDC element 300 shown in FIG. 6.

As compared with the embodiment shown in FIGS. 5 and 6, instead of the first contact 402 and the second contact 403 being generally linear along a longitudinal axis 430, the alternative IDC element 400 is arced in a direction such that the open ends of the first insulation displacement slot 411 and second insulation displacement slot 421 would be directed generally towards the pivot portion 166 of the cap 106 (see FIG. 5). The first leg 407 and second leg 409 of the first contact 402 and the first leg 417 and second leg 419 of the second contact 403 are shown in FIG. 10 as being arced uniformly with respect to the longitudinal axis 430. In one embodiment, the arced portion of the IDC element 400 traces a circumferential arc relative to the pivot axis of the pivoting cap 106. Each contact may be arced independently of the other contact with each contact having a different radius of curvature. Further, one contact may be arced, while the other contact is linear.

Although not shown, the alternative IDC element 400 may be laterally angled as shown in FIGS. 9A and 9B to form inside slot edges for assisting in displacing the insulation from electrical conductors. Further, as discussed above, the arcs of the first contact 402 and second contact 403 may be uniform as shown or non-uniform.

FIG. 11 is a perspective view through the connector unit 104 (shown in phantom) showing the connection between the first IDC element 300 and an electrical element 114. The first IDC element 300 is positioned in the connector unit 104 with the tail 305 extending into the base unit 102 (not shown). The electrical element 114 is an IDC element, which makes electrical connection with cables that may be connected to the office or the subscriber. The electrical element 114 has a tail 114*a* that resiliently and electrically contacts the tail 305 of the first IDC element 300.

FIG. 12 is a perspective view through the connector unit 104 (shown in phantom) showing a test probe 350 inserted between the connection of the first IDC element 300 and the electrical element 114. The test probe 350 is first inserted through the test probe slot 152 (see FIG. 2 and FIG. 4). The test probe 350 is capable of breaking the contact between the first IDC element 300 tail 305 and the tail 114*a* of the electrical element 114. Breaking this connection and using a test probe, as is known in the art, allows the tester to electronically isolate a circuit on both sides of the test probe 305 at the IDC tail connections and thus to test both ways for problems.

Although FIGS. 11 and 12 only show the electrical connection between the first IDC element 300 and electrical element 114, it is understood that the second IDC element 301 would also make a connection to another electrical element (similar to the element 114 shown and described). However, the second IDC element 301 is positioned on the second section 137 of the housing and therefore on the opposite side of the test probe slot 152. The test probe 350 is capable of entering the test probe slot 152 and breaking the resilient connection between the tail of the second IDC element 301 and the tail of the other electrical element (the tail orientations would be similar to that described above, but in reverse).

Although the present invention has been described with reference to preferred embodiments, workers skilled in the art will recognize that changes may be made in form and detail without departing from the spirit and scope of the invention.

What is claimed is:

1. An electrically coupled insulation displacement system comprising:

a first contact including a first insulation displacement slot therein for receiving a first and a second electrical conductor, the first insulation displacement slot having an open end and a closed end, the first insulation displacement slot having a first portion having a width adjacent the open end and a second portion having a width intermediate the first portion and the closed end, the first portion having a larger width than the second portion;

a second contact electrically coupled to the first contact, the second contact including a second insulation displacement slot therein for receiving the first and the second electrical conductor, the second insulation displacement slot having an open end and a closed end, the second insulation displacement slot having a first portion having a width adjacent the open end and a second portion having a width intermediate the first portion and the closed end, the first portion having a smaller width than the second portion, wherein a plane defined by the insulation displacement slot of the first contact and the insulation displacement slot of the second contact defines a centerline of the insulation displacement system; and a coupling tail resiliently projecting from the first contact and the second contact, the coupling tail offset from the centerline of the insulation displacement system.

2. The insulation displacement system of claim 1, in combination with a first electrical conductor, further comprises:

the first electrical conductor electrically coupled to the first contact at the second portion and the first electrical conductor passes through the second portion of the second contact.

3. The insulation displacement system of claim 1, in combination with a second electrical conductor, further comprises:

the second electrical conductor electrically coupled to the second contact at the first portion and the second electrical conductor passes through the first portion of the first contact.

4. The insulation displacement system of claim 1, wherein the first insulation displacement slot and the second insulation displacement slot are generally linearly aligned.

5. The insulation displacement system of claim 1, wherein at least the second portion of the first insulation displacement slot has a lateral dimension with a varying width from a first edge to a second edge.

6. The insulation displacement system of claim 1, wherein at least the first portion of the second insulation displacement slot has a lateral dimension with a varying width from a first edge to a second edge.

7. The insulation displacement system of claim 1, further comprising:

a second insulation displacement system including a third contact having a third insulation displacement slot and a fourth contact having a fourth insulation displacement slot.

8. The insulation displacement system of claim 7, wherein the first insulation displacement slot and the second insulation displacement slot are generally linearly aligned along a first plane, and the third insulation displacement slot and the fourth insulation displacement slot are generally linearly aligned along a second plane.

9. The insulation displacement system of claim 8, wherein the first plane and the second plane are generally parallel.

10. The insulation displacement system of claim 1, wherein the coupling tail is configured to make contact with a coupling element.

11. The insulation displacement system of claim 10, wherein a test probe may be inserted between the coupling tail and the coupling element.

12. An electrically coupled insulation displacement system comprising:

a first contact including a first insulation displacement slot therein for receiving a first and a second electrical conductor, the first insulation displacement slot having an open end and a closed end, the first insulation displacement slot having a first portion having a width adjacent the open end and a second portion having a width intermediate the first portion and the closed end, the first portion having a larger width than the second portion;

a second contact including a second insulation displacement slot therein for receiving the first and the second electrical conductor, the second insulation displacement slot having an open end and a closed end, the second insulation displacement slot having a first portion having a width adjacent the open end and a second portion having a width intermediate the first portion and the closed end, the first portion having a smaller width than the second portion;

a third contact having a third insulation displacement slot; and a fourth contact having a fourth insulation displacement slot;

wherein the first insulation displacement slot and the second insulation displacement slot are generally linearly aligned along a first plane, and the third insulation displacement slot and the fourth insulation displacement slot are generally linearly aligned along a second plane;

wherein the first and second insulation displacement slots along the first plane are linearly staggered from the third and fourth insulation displacement slots along the second plane.

13. An electrically coupled insulation displacement system comprising:

a first contact including a first insulation displacement slot therein for receiving a first and a second electrical conductor, the first insulation displacement slot having an open end and a closed end, the first insulation displacement slot having a first portion having a width adjacent the open end and a second portion having a width intermediate the first portion and the closed end, the first portion having a larger width than the second portion; and a second contact including a second insulation displacement slot therein for receiving the first and the second electrical conductor, the second insulation displacement slot having an open end and a closed end, the second insulation displacement slot having a first portion having a width adjacent the open end and a second portion having a width intermediate the first portion and the closed end, the first portion having a smaller width than the second portion;

wherein at least a portion of at least one of the first insulation displacement slot and the second insulation displacement slot is curved along a longitudinal axis.

14. The insulation displacement system of claim 13, wherein at least a portion of the first insulation displacement slot is curved along a longitudinal axis and at least a portion of the second insulation displacement slot is curved along a longitudinal axis, wherein the first insulation displacement slot and the second insulation displacement slot curve in a uniform direction.

15. An electrically connected insulation displacement system comprising:

a first contact having a generally U-shape and including a first leg and a second leg spaced from one another to define a first insulation displacement slot, wherein the first insulation displacement slot includes a wide portion near a top of the first leg and second leg and a narrow portion near a middle of the first leg and second leg, wherein at the wide portion the first leg and second leg are spaced further from one another compared to the narrow portion; and a second contact electrically coupled to the first contact, the second contact having a generally U-shape and including a first leg and a second leg spaced from one another to define a second insulation displacement slot, wherein the second insulation displacement slot includes a wide portion near a middle of the first leg and second leg and a narrow portion near a top of the first leg and second leg, wherein at the wide portion the first leg and second leg are spaced further from one another compared to the narrow portion, wherein a plane passing between the first and second legs of the first contact and the first and second legs of the second contact defines a centerline of the insulation displacement system; and a coupling tail resiliently projecting from the first contact and the second contact, the coupling tail offset from the centerline of the insulation displacement system.

16. The insulation displacement system of claim 15 in combination with a first electrical conductor, further comprises:

the first electrical conductor electrically coupled to the first contact at the narrow portion, and the first electrical conductor passes through the wide portion of the second contact.

17. The insulation displacement system of claim 15 in combination with a second electrical conductor, further comprises:

the second electrical conductor electrically coupled to the second contact at the narrow portion, and the second electrical conductor passes through the wide portion of the first contact.

18. The insulation displacement system of claim 15, wherein the first insulation displacement slot and the second insulation displacement slot are generally linearly aligned.

19. The insulation displacement system of claim 15, further comprising:

a second insulation displacement system including a third contact having a third insulation displacement slot and a fourth contact having a fourth insulation displacement slot.

20. The insulation displacement system of claim 19, wherein the first insulation displacement slot and the second insulation displacement slot are generally linearly aligned along a first plane, and the third insulation displacement slot and the fourth insulation displacement slot are generally linearly aligned along a second plane.

21. The insulation displacement system of claim 20, wherein the first plane and the second plane are generally parallel.

22. The insulation displacement system of claim 15, wherein the coupling tail is configured to make contact with a coupling element.

23. The insulation displacement system of claim 22, wherein a test probe may be inserted between the coupling tail and the coupling element.

24. An electrically connected insulation displacement system comprising:

a first contact having a generally U-shape and including a first leg and a second leg spaced from one another to define a first insulation displacement slot, wherein the first insulation displacement slot includes a wide portion near a top of the first leg and second leg and a narrow portion near a middle of the first leg and second leg, wherein at the wide portion the first leg and second leg are spaced further from one another compared to the narrow portion;

a second contact having a generally U-shape and including a first leg and a second leg spaced from one another to define a second insulation displacement slot, wherein the second insulation displacement slot includes a wide portion near a middle of the first leg and second leg and a narrow portion near a top of the first leg and second leg, wherein at the wide portion the first leg and second leg are spaced further from one another compared to the narrow portion;

a third contact having a third insulation displacement slot; and a fourth contact having a fourth insulation displacement slot;

wherein the first insulation displacement slot and the second insulation displacement slot are generally linearly aligned along a first plane, and the third insulation displacement slot and the fourth insulation displacement slot are generally linearly aligned along a second plane; and wherein the first and second insulation displacement slots along the first plane are linearly staggered from the third and fourth insulation displacement slots along the second plane.

25. An electrically connected insulation displacement system comprising:

a first contact having a generally U-shape and including a first leg and a second leg spaced from one another to define a first insulation displacement slot, wherein the first insulation displacement slot includes a wide portion near a top of the first leg and second leg and a narrow portion near a middle of the first leg and second leg, wherein at the wide portion the first leg and second leg are spaced further from one another compared to the narrow portion; and a second contact having a generally U-shape and including a first leg and a second leg spaced from one another to define a second insulation displacement slot, wherein the second insulation displacement slot includes a wide portion near a middle of the first leg and second leg and a narrow portion near a top of the first leg and second leg, wherein at the wide portion the first leg and second leg are spaced further from one another compared to the narrow portion;

wherein a portion of at least one of the first leg or the second leg of at least one of the first contact and the second contact is positioned at a non-orthogonal angle with respect to a plane passing between the first leg and the second leg of the first contact and the first leg and the second leg of the second contact.

26. The insulation displacement system of claims 25, wherein at least a portion of the first leg and the second leg of at least one of the first contact and the second contact are symmetrically positioned at a non-orthogonal angle with respect to the plane passing between the first leg and the second leg of the first contact and the first leg and the second leg of the second contact.

27. An electrically connected insulation displacement system comprising:

a first contact having a generally U-shape and including a first leg and a second leg spaced from one another to define a first insulation displacement slot, wherein the first insulation displacement slot includes a wide portion near a top of the first leg and second leg and a narrow portion near a middle of the first leg and second leg, wherein at the wide portion the first leg and second leg are spaced further from one another compared to the narrow portion; and a second contact having a generally U-shape and including a first leg and a second leg spaced from one another to define a second insulation displacement slot, wherein the second insulation displacement slot includes a wide portion near a middle of the first leg and second leg and a narrow portion near a top of the first leg and second leg, wherein at the wide portion the first leg and second leg are spaced further from one another compared to the narrow portion wherein the first leg and the second leg of at least one of the first contact and the second contact are arcuately curved along at least a portion of a length of the first leg and the second leg of the first contact.

28. The insulation displacement system of claim 27, wherein the first leg and the second leg of the first contact are arcuately curved along at least a portion of a length of the first leg and the second leg of the first contact, and the first leg and the second leg of the second contact are arcuately curved along at least a portion of a length of the first leg and the second leg of the second contact, wherein the legs of the first contact and the legs of the second contact curve in a uniform direction.

29. A method of connecting a first and a second electrical conductor, each having an insulation surrounding a conductive core, to an electrically coupled insulation displacement system comprising:

providing a first contact including a first slot, the first slot having an open end and a closed end, the first slot having a first portion having a width adjacent the open end and a second portion having a width intermediate the first portion and the closed end, the first portion having a larger width than the second portion;

providing a second contact, electrically coupled to the first contact, the second contact including a second slot, the second slot having an open end and a closed end, the second slot having a first portion having a width adjacent the open end and a second portion having a width intermediate the first portion and the closed end, the first portion having a smaller width than the second portion, wherein a plane defined by the first slot of the first contact and the second slot of the second contact defines a centerline of the insulation displacement system;

providing a resiliently deflectable coupling tail extending from the first contact and the second contact, the coupling tail offset from the centerline of the insulation displacement system;

positioning the first electrical conductor above the first contact and the second contact;

inserting the first electrical conductor into the slots of the first contact and the second contact;

positioning the second electrical conductor above the slots of the first contact and the second contact and above the first electrical conductor; and inserting the second electrical conductor into the slots of the first contact and the second contact, wherein the conductive core of the first electrical conductor electrically engages the second portion of the first slot and the conductive core of the second electrical conductor electrically engages the first portion of the second slot.

30. The method of claim 29, and further comprising:

resiliently electrically connecting the coupling tail to a coupling element.

31. The method of claim 30, and further comprising:

inserting a test probe between the coupling tail and the coupling element.

32. A method of connecting a first and a second electrical conductor, each having an insulation surrounding a conductive core, to an electrically coupled insulation displacement system comprising:

providing a first contact including a first slot, the first slot having an open end and a closed end, the first slot having a first portion having a width adjacent the open end and a second portion having a width intermediate the first portion and the closed end, the first portion having a larger width than the second portion;

providing a second contact, electrically coupled to the first contact, the second contact including a second slot, the second slot having an open end and a closed end, the second slot having a first portion having a width adjacent the open end and a second portion having a width intermediate the first portion and the closed end, the first portion having a smaller width than the second portion;

providing a housing including a cavity for containing the first contact and second contact; and providing a cap pivotally mounted to the housing, the cap including a pivot portion and a cover portion, with an opening through the pivot portion of the cap;

positioning the first electrical conductor above the first contact and the second contact;

inserting the first electrical conductor into the slots of the first contact and the second contact, wherein the step of inserting the first electrical conductor further comprises inserting the first electrical conductor into the opening of the cap; and inserting the second electrical conductor into the slots of the first contact and the second contact, wherein the step of inserting the second electrical conductor further comprises inserting the second electrical conductor into the opening of the cap;

wherein the conductive core of the first electrical conductor electrically engages the second portion of the first slot and the conductive core of the second electrical conductor electrically engages the first portion of the second slot.

33. The method of claim 32, wherein the inserting the first electrical conductor step further comprises:

pivoting the cap to a closed position relative to the housing.

34. The method of claim 32, wherein the inserting the second electrical conductor step further comprises:

pivoting the cap to a closed position relative to the housing.

35. The method of claim 32, wherein the inserting the first electrical conductor and inserting the second electrical conductor steps further comprise:

simultaneously pivoting the cap to a closed position relative to the housing.

36. The method of claim 32, further comprising:

providing a cutting edge within the cavity of the housing adjacent the opening through the cap; and pivoting the cap to a closed position relative to the cavity of the housing, wherein the blade severs the portion of the first electrical conductor and second electrical conductor passing through the opening when the cap is pivoted to the closed position.

37. The method of claim 36, and further comprising:

discarding the portion of the first electrical conductor and second electrical conductor which is in the opening after the conductors are severed.

38. A method of connecting a first and a second electrical conductor having an insulation surrounding a conductive core to a pair of insulation displacement connectors, the method comprises:

providing a first contact having a generally U-shape and including a first leg and a second leg spaced from one another to define a first slot, wherein the first slot includes a wide portion near a top of the first leg and second leg and a narrow portion near a middle of the first leg and second leg, wherein at the wide portion the first leg and second leg are spaced further from one another compared to the narrow portion;

providing a second contact having a generally U-shape and including a first leg and a second leg spaced from one another to define a second slot, wherein the second slot includes a narrow portion near a top of the first leg and second leg and a wide portion near a middle of the first leg and second leg, wherein at the wide portion the first leg and second leg are spaced further from one another compared to the narrow portions, wherein a plane passing between the first and second legs of the first contact and the first and second legs of the second contact defines a centerline of the insulation displacement system;

providing a resiliently deflectable coupling tail extending from the first contact and the second contact, the coupling tail offset from the centerline of the insulation displacement system;

positioning the first electrical conductor above the first contact and the second contact;

inserting the first electrical conductor into the slots of the first contact and the second contact;

positioning the second electrical conductor above the first contact and the second contact; and inserting the second electrical conductor into the slots of the first contact and the second contact, wherein the conductive core of the first electrical conductor electrically engages the narrow portion of the first slot and the conductive core of the second electrical conductor electrically engages the narrow portion of the second slot.

39. The method of claim 38, and further comprising resiliently and electrically connecting the coupling tail to a coupling element.

40. The method of claim 39, and further comprising:

inserting a test probe between the coupling tail and the coupling element.

41. A method of connecting a first and a second electrical conductor having an insulation surrounding a conductive core to a pair of insulation displacement connectors, the method comprises:

providing a first contact having a generally U-shape and including a first leg and a second leg spaced from one another to define a first slot, wherein the first slot includes a wide portion near a top of the first leg and second leg and a narrow portion near a middle of the first leg and second leg, wherein at the wide portion the first leg and second leg are spaced further from one another compared to the narrow portion;

providing a second contact having a generally U-shape and including a first leg and a second leg spaced from one another to define a second slot, wherein the second slot includes a narrow portion near a top of the first leg and second leg and a wide portion near a middle of the first leg and second leg, wherein at the wide portion the first leg and second leg are spaced further from one another compared to the narrow portion:

providing a housing including a cavity for containing the first contact and second contact; and providing a cap pivotally mounted to the housing, the cap including a pivot portion and a cover portion, with an opening through the pivot portion of the cap;

positioning the first electrical conductor above the first contact and the second contact;

inserting the first electrical conductor into the slots of the first contact and the second contact, wherein the step of inserting the first electrical conductor further comprises inserting the first electrical conductor into the opening of the cap and inserting the second electrical conductor into the slots of the first contact and the second contact, wherein the step of inserting the second electrical conductor further comprises inserting the second electrical conductor into the opening of the cap;

wherein the conductive core of the first electrical conductor electrically engages the narrow portion of the first slot and the conductive core of the second electrical conductor electrically engages the narrow portion of the second slot.

42. The method of claim 41, wherein the inserting the first electrical conductor step further comprises:

pivoting the cap to a closed position relative to the housing.

43. The method of claim 41, wherein the inserting the second electrical conductor step further comprises:

pivoting the cap to a closed position relative to the housing.

44. The method of claim 41, wherein the inserting the first electrical conductor and inserting the second electrical conductor steps further comprise:

simultaneously pivoting the cap to a closed position relative to the housing.

45. The method of claim 41, further comprising:

providing a cutting edge within the cavity of the housing adjacent the opening through the cap; and pivoting the cap to a closed position relative tot he cavity of the housing, wherein the blade severs the portion of the first electrical conductor and second electrical conductor passing through the opening when the cap is pivoted to the closed position.

46. The method of claim 45, and further comprising:

discarding the portion of the first electrical conductor and second electrical conductor which is in the opening after the conductors are severed.

* * * * *

UNITED STATES PATENT AND TRADEMARK OFFICE

CERTIFICATE OF CORRECTION

PATENT NO. : 7,101,216 B2
APPLICATION NO. : 10/941506
DATED : September 5, 2006
INVENTOR(S) : Xavier Fasce It is certified that error appears in the above-identified patent and that said Letters Patent is hereby corrected as shown below:

Title Page Item (56)
Page 2, Column 1, (U.S. Patent Documents),
Line 21, after "6,582,247" delete "B1" and insert --B2--, therefor.
Line 22, after "6,604,956" delete "B1" and insert -- B2 --, therefor.

Title Page Item (56)
Page 2, Column 2, (Other Publications),
Lines 13—15, delete "U.S. Appl. No. 10/941,441; Xavier Fasce et al, filed Sep. 15, 2004, entitled "Connector Assembly for Housing Insulation Displacement Elements".".
(Repeated Entry)
Lines 16—17, delete "U.S. Appl. No. 29/213197; Xavier Fasce et al, filed Sep. 15, 2004, entitled "Cap For Electrical Connector".".
(Repeated Entry)

Column 4, Line 27, delete "all" and insert -- wall--, therefor.

Column 9, Line 35, (Approx.), delete "maybe" and insert -- may be --, therefor.

Column 18, Line 59, in Claim 38, delete "portions," and insert -- portion, --, therefor.

Column 19,
Line14, in Claim 39, after "comprising" insert -- : --.
Line39, in Claim 41, delete "portion:" and insert -- portion; --, therefor.

UNITED STATES PATENT AND TRADEMARK OFFICE

CERTIFICATE OF CORRECTION

PATENT NO. : 7,101,216 B2
APPLICATION NO. : 10/941506
DATED : September 5, 2006
INVENTOR(S) : Xavier Fasce It is certified that error appears in the above-identified patent and that said Letters Patent is hereby corrected as shown below:

Column 20, Line 34, (Approx.), in Claim 45, delete "tot he" and insert -- to the --, therefor.

Signed and Sealed this

Fourteenth Day of November, 2006

JON W. DUDAS
*Director of the United States Patent and Trademark Office*